US007503131B2

(12) United States Patent
Nadel et al.

(10) Patent No.: US 7,503,131 B2
(45) Date of Patent: Mar. 17, 2009

(54) SKI BOOT TIGHTENING SYSTEM

(76) Inventors: Adam Ian Nadel, 2036 Palm Place Dr., Palm Bay, FL (US) 32905; Garrett Quillia, 124 Evergreen La., White River Junction, VT (US) 05001

( * ) Notice: Subject to any disclaimer, the term of this patent is extended or adjusted under 35 U.S.C. 154(b) by 438 days.

(21) Appl. No.: 11/433,939

(22) Filed: May 15, 2006

(65) Prior Publication Data

US 2007/0261270 A1 Nov. 15, 2007

(51) Int. Cl.
*A43B 5/04* (2006.01)

(52) U.S. Cl. ..... 36/50.5; 36/117.1

(58) Field of Classification Search ..... 36/50.1, 36/50.5, 117.1

See application file for complete search history.

(56) References Cited

U.S. PATENT DOCUMENTS

| | | | | | |
|---|---|---|---|---|---|
| 469,889 | A | | 3/1892 | Sparks | |
| 1,625,258 | A | | 4/1927 | Jelbert | |
| 2,553,390 | A | | 5/1951 | Streyckmans | |
| 2,917,621 | A | | 12/1959 | Higgins | |
| 4,724,626 | A | * | 2/1988 | Baggio | 36/117.8 |
| 4,739,563 | A | | 4/1988 | Guggenberger et al. | |
| 4,741,115 | A | * | 5/1988 | Pozzobon | 36/117.7 |
| 4,787,124 | A | * | 11/1988 | Pozzobon et al. | 24/68 SK |
| 5,174,051 | A | * | 12/1992 | Walkhoff et al. | 36/118.9 |
| 5,188,052 | A | | 2/1993 | Breuer | |
| 5,313,720 | A | | 5/1994 | De Bortoli et al. | |
| 5,379,531 | A | | 1/1995 | Iwama | |
| 5,590,481 | A | * | 1/1997 | Vaccari | 36/118.8 |
| 5,720,119 | A | | 2/1998 | Benoit | |
| 6,026,594 | A | * | 2/2000 | Fougere | 36/50.5 |
| 6,202,953 | B1 | * | 3/2001 | Hammerslag | 242/396.1 |
| 6,289,558 | B1 | | 9/2001 | Hammerslag | |
| 6,598,322 | B2 | * | 7/2003 | Jacques et al. | 36/50.1 |
| 7,320,191 | B2 | * | 1/2008 | Trinkaus et al. | 36/118.2 |
| 2007/0294918 | A1 | * | 12/2007 | Hubner | 36/50.1 |
| 2008/0066345 | A1 | * | 3/2008 | Hammerslag et al. | 36/50.1 |

* cited by examiner

*Primary Examiner*—Marie Patterson
(74) *Attorney, Agent, or Firm*—Hayworth, Chaney & Thomas; Stephen C. Thomas; Robert A. Lynch

(57) ABSTRACT

Disclosed is an electro-mechanical apparatus for snugging a boot, especially a snow ski boot, around the calf of the user. The apparatus is essentially comprised of a reversible electric motor, a jackscrew, a switch, two brackets, a strap, and a power supply. The invention enables the user to achieve a desired snug fit by first placing a foot of the user into the boot, then operating the electric motor to turn the jackscrew, bringing the two brackets together and thereby tightening the strap around the boot to reach the desired fit. Once the desired snug fit is achieved, the electric motor is switched off, the user closes pre-existing latches on the boot to lock the boot parts into place, and the user removes the apparatus from around the boot by unbuckling a quick release buckle provided for this purpose. The apparatus may then be stored for later use. The reversible feature of the electric motor enables the operator to reverse the direction of travel of the jackscrew and thereby widen the gap between the brackets so that the apparatus is ready to be used again.

Also disclosed is a method of tightening the parts of a boot onto the calf of a user utilizing a strap surrounding the parts of the boot and an electric motor to tighten the strap to reach the desired snug fit. Once the desired fit is achieved, the user removes the apparatus by releasing a quick release buckle.

13 Claims, 9 Drawing Sheets

SKI BOOT TIGHTENING SYSTEM

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

BACKGROUND OF THE INVENTION

1. Field of the Invention

The present invention relates to an apparatus to aid in the wearing of footwear. More specifically, the present invention relates to a system utilized for tightening boots around the calf of the wearer. An example of such boots are those utilized for snow skiing.

2. Background Art

Ski boots are commonly used to aid a snow skier in the wearing of snow skis. Ski boots are commonly constructed of a rigid multi-part outer shell material with a soft inner lining, and they are commonly attached to the snow skis in a fixed fashion. The rigid outer shell material is typically designed in a multipart arrangement which allows the wearer to open the parts of the boot, insert his foot, and close the parts of the boot around the foot, ankle, and calf. The wearer then presses the boot parts together around the calf until the desired snug fit is reached, whereupon the wearer operates locking latches on the boot to lock the boot parts into place. Such boots are typically large and bulky, and it is often desired to achieve a tight fit around the wearer's calf and ankle. In order to achieve a tight fit of the boot around the foot, ankle, and calf of the wearer, it is typically desirable to create a snug circumferential pressure that is evenly distributed around the wearer's calf prior to locking down the latching mechanisms of the ski boot. It is often difficult to achieve a significant snug fit due to the size and shape of the boot, and due to the fact that most individuals wear bulky ski clothing which may prevent the wearer from being able to maintain adequate pressure on the ski boot parts while closing the ski boot latches.

There currently exist a number of mechanisms, systems, and methods for tightening a ski boot around the wearer's calf. A traditional method comprises a series of cam action locks located along the front, side, or rear of the ski boot which operate to lock the parts of the boot parts together. The wearer inserts his foot into the boot and uses his hands or fingers to push the parts of the boot together. The wearer then must hold the boot parts together while at the same time closing the latches on the boot without allowing the boot parts to become loose. Sometimes a second person is required to aid in this process. The amount of force required to operate the cam action locks for such traditional ski boot closures can easily exceed the strength ability of the wearer. This can be especially true for elderly or young skiers, or those with compromised strength in their hands and fingers such as persons suffering from arthritis.

Several systems have been proposed with the goal of aiding the ski boot wearer in tightening boots, especially snow ski boots. U.S. Pat. No. 5,313,720 to De Bortoli et al. describes one such system comprised of a cable surrounding the boot which is latched shut using a cam lever arrangement. The cam lever of the U.S. Pat. No. 5,313,720 patent exhibits the same drawback as the cam lever arrangements of traditional ski boot closures in that it requires a significant amount of finger or hand pressure by the wearer. Other systems have been proposed with the goal of tightening boots with lacing closures. One such system is described in United States patent number U.S. Pat. No. 6,289,558 B1 to Hammerslag. This United States patent describes a footwear lacing system intended to be utilized with the standard laces, such as those provided as a closure mechanism for ice skates. The invention described in the U.S. Pat. No. 6,289,558 patent is not applicable for footwear utilizing a non-lacing type closure, and is therefore not appropriate for use with standard ski boots which are typically comprised of a cam lever closure mechanism.

Another such boot tightening the system is described in U.S. Pat. No. 5,720,119 to Benoit. This United States patent describes a boot tightening system comprised of a flexible strap surrounding the front part of the ski boot connected to a screw arrangement for tightening the strap, said screw arrangement placed vertically along the rear of the ski boot. The invention described in the U.S. Pat. No. 5,720,119 patent is permanently affixed to the ski boot, and thus cannot be moved from boot to boot or utilized by a plurality of wearers. Yet another ski boot tightening system is described and U.S. Pat. No. 4,739,563 to Buggenberger et al. This United States patent describes a complicated hydraulic system utilizing a mechanical coupling arrangement to achieve a desired adjustment for the ski boot. This system is also permanently affixed to the ski boot and thus cannot be moved from boot to boot, or utilized by a plurality of wearers.

Another such boot tightening system is described in U.S. Pat. No. 4,787,124 to Pozzobon et al. This United States patent describes an actuation system for use in ski boots which is comprised of a complicated winder mechanism that is permanently affixed to the boot. As such it cannot be moved from boot to boot or utilized by a plurality of wearers. Another such permanently affixed boot tightening system is described in U.S. Pat. No. 5,379,531 to Iwama.

There is therefore a need for a tightening system for boots, especially snow ski boots, which does not require significant strength in the hands or fingers of the wearer, which is usable among a plurality of wearers, which effectively tightens the ski boot around the calf of the wearer without significant effort, which is not permanently affixed to the ski boot, and which is portable and simple to use.

BRIEF SUMMARY OF THE INVENTION

The present invention overcomes the drawbacks of the aforementioned inventions. An apparatus for tightening boots, especially snow ski boots, the present invention is preferably comprised of a flexible strap connected at both ends to brackets specially designed to receive the strap, a jackscrew mechanism for bringing the two brackets together in a controlled fashion such that the strap is tightened around the boot causing the parts of the boot to become snug around the calf of the wearer, and a small electric motor utilized to rotate the screw mechanism upon command by the user. After reaching the desired snug fit of the boot parts around the calf, the wearer operates the existing boot latches to lock the parts of the boot in place. The flexible strap is comprised of a flexible material such as nylon webbing or similar strap material which is stretch resistant, and is further comprised of a release buckle which allows the wearer to release the strap and remove the entire boot tightener apparatus after the ski boot latches are secure. The release buckle allows the user to utilize the invention to apply pressure to the various components of the ski boot, causing the ski boot to snugly fit around the user's calf and to be held in position so that the user can easily actuate the existing levers on the ski boot to lock the tightened parts of the ski boot in place. After the ski boot is locked in place, the ski boot tightening apparatus is removed by releasing the quick release buckle and stored for later use. The act of pressing the parts of the boot against the calf of the wearer to reach a desired snug fit is termed "snugging" the boot.

It is an aspect of the invention that it is portable from boot to boot, and therefore is usable among a plurality of ski boot wearers. It is a further aspect of the invention that it is easily operable by individuals who have compromised strength in their hands and fingers, such as those individuals who are young, elderly, or suffer from arthritis. It is yet a further aspect of the invention that it is usable on a wide variety of ski boot types and styles. The invention is not limited to any particular variety, brand, type, or style of snow ski boot.

DETAILED DESCRIPTION OF THE INVENTION

Figure 1:
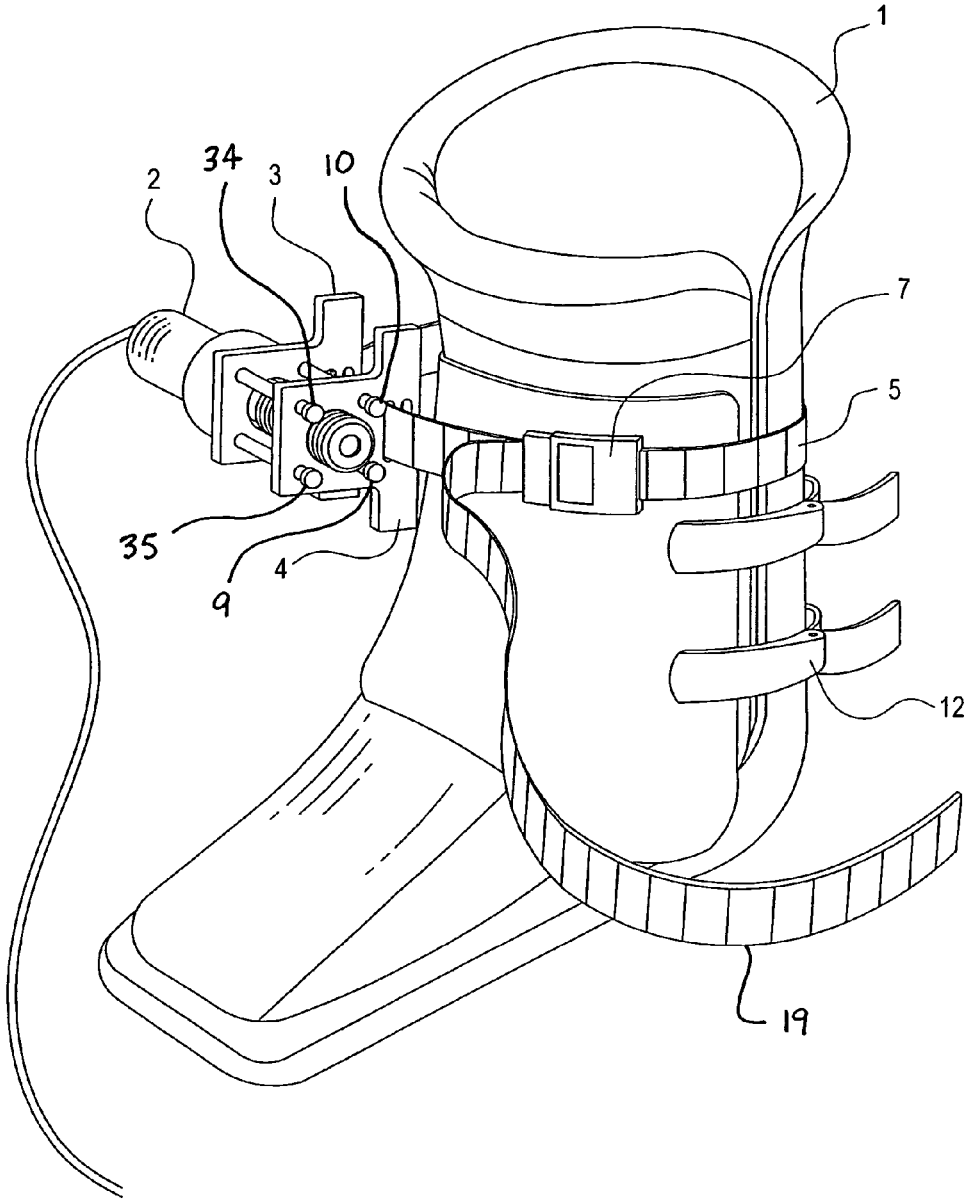
FIG. 1 is a perspective view of the boot tightening apparatus installed on a typical snow ski boot.
Figure 2:
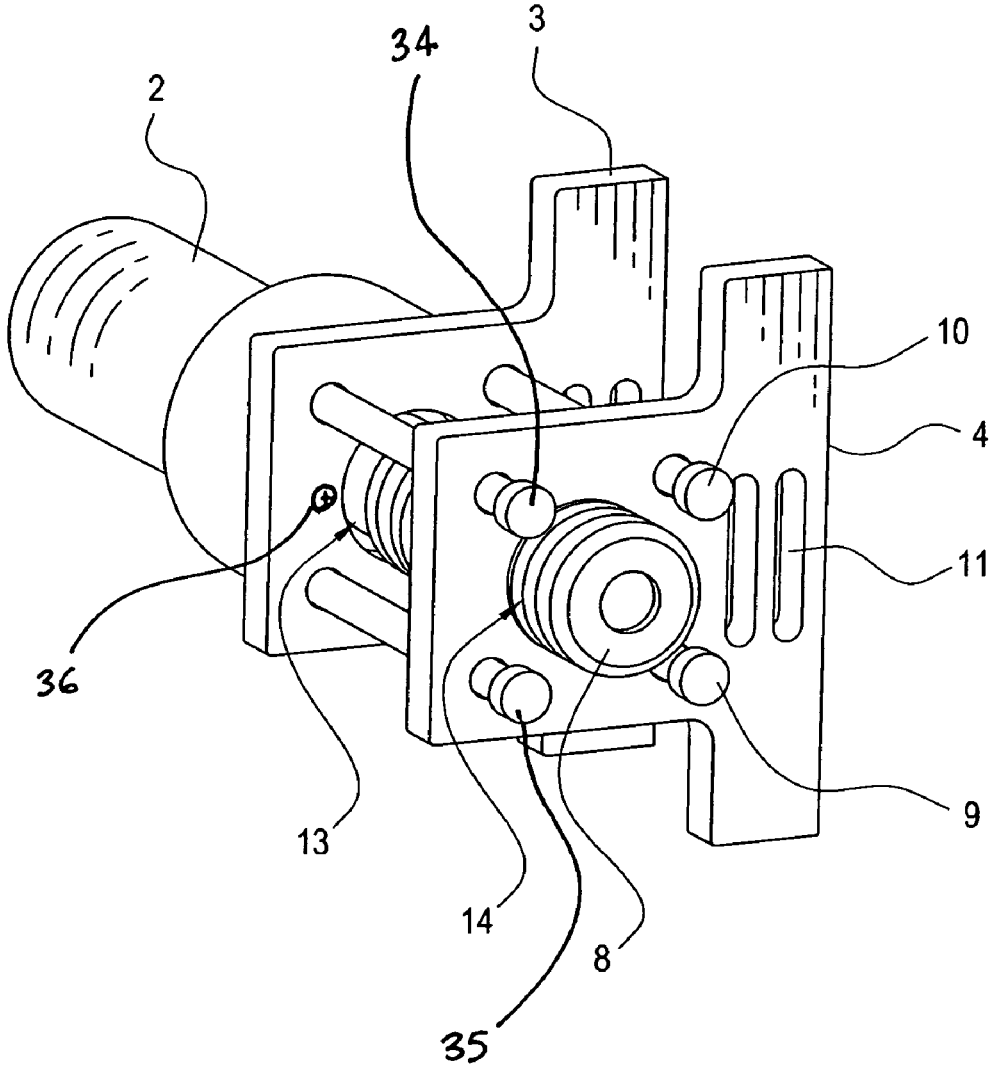
FIG. 2 is a perspective view of the boot tightening apparatus, with the flexible strap removed.

The invention is directed to an apparatus and a method for tightening boots, especially snow ski boots, around the foot, ankle, and calf of the wearer. Referring to the figures of the drawings, the apparatus is preferably comprised of an electric motor 2 having an output shaft and a first surface 41, a first bracket 3, a second bracket 4, a flexible strap 5 having a quick release buckle 7 and a first end and a second end, a power supply 6, a switch 20, a first shoulder bolt 9, a second shoulder bolt 10, a third shoulder bolt 34, a fourth shoulder bolt 35, a first electrical conduction means 21, a second electrical conduction means 22, a third electrical conduction means 27, a fourth electrical conduction means 28, and a jackscrew 8.

A first alternate embodiment of the invention is comprised of an electric motor 2 having an output shaft and a first surface 41, a first bracket 3, a second bracket 4, a flexible strap 5 having a quick release buckle 7 and a first end and a second end, a power supply 6, a switch 20, a first electrical conduction means 21, a second electrical conduction means 22, a third electrical conduction means 27, a fourth electrical conduction means 28, and a jackscrew 8.

Said switch 20 is a switch for controlling electric motor 2 and is comprised of an electrical switch and a first and second pair of electrical terminals. Switch 20 is capable of three positions: a FORWARD position, a REVERSE position, and an OFF position, and is in communication with power supply 6. A preferred embodiment is one wherein switch 20 is a momentary switch so constructed as to provide an increasing electric current as the switch is manipulated further into either the FORWARD or REVERSE position, and wherein the switch returns to the OFF position when the user removes pressure on the switch. Such switches are common in the art and are used in electric controllers for bi-directional and reversible direct current motors.

Said power supply 6 is comprised of a electric power source of sufficient voltage to cause said output shaft of said electric motor 2 to turn when said voltage is applied to said electric motor 6 by operation of said switch 20 in said FORWARD state or said REVERSE state, and a pair of electrical connection terminals 40 for communication with switch 20.

Electric motor 2 operates to rotate jackscrew 8 and is comprised of an electric motor having a pair of electrical terminals 37. Electric motor 2 may be any type of small electric motor well known in the art. A preferred embodiment of electric motor 2 is a variable speed, direct-current reversible electric motor capable of operating in a FORWARD state, a REVERSE state, and an OFF state. In said FORWARD state, said electric motor output shaft operates in counter-clockwise rotation as viewed toward said electric motor when said switch 20 is operated into the FORWARD position. In said REVERSE state, said electric motor output shaft operates in clockwise rotation as viewed toward said electric motor when said switch 20 is operated into the REVERSE position. In said OFF state, the electric motor output shaft does not turn when said switch 20 is operated into the OFF position. Such electric motors are common in the art and are used, for example, in cordless drills which are readily available in hardware stores. A preferred embodiment of power supply 6 is a rechargeable battery which supplies sufficient output voltage to cause the output shaft of electric motor 2 to rotate. Such rechargeable batteries are common in the art and are used in connection with portable power tools such as cordless drills. An alternative embodiment of the power supply is that in which replaceable batteries are used instead of a rechargeable battery. Either one or a plurality of replaceable batteries may be used in such an alternative embodiment. Replaceable batteries used to power small direct current motors are well known in the art and are readily available for consumer purchase.

Alternatively, the direction of turning may be opposite as described above when the motor is commanded into the FORWARD or REVERSE state. The direction of turning does not affect the operability, use, or effectiveness of the invention.

Figure 6:
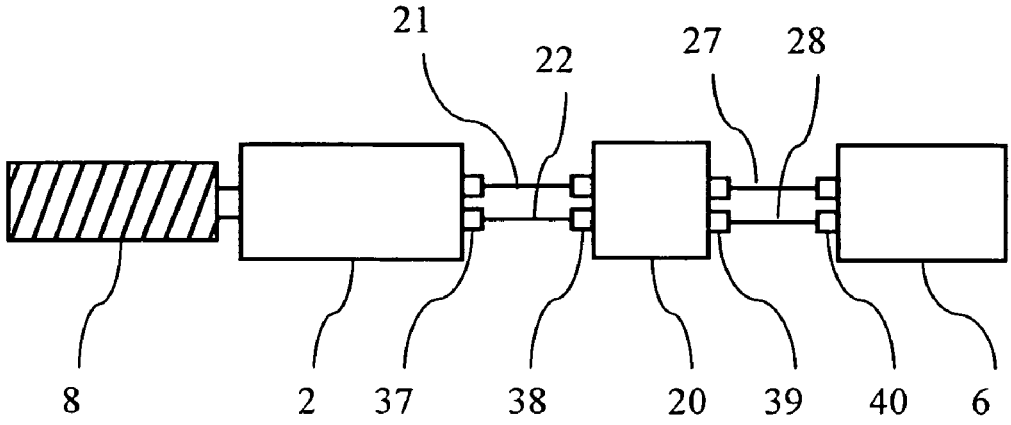
FIG. 6 is a schematic diagram of the invention.

Referring to FIG. 6, said electric motor 2 is in communication with switch 20 by electrical conducting means 21 and 22 connected between said electric motor pair of electrical connection terminals 37 and said switch first pair of electric terminals 38. Switch 20 is in communication with power supply 6 by electrical conducting means 27 and 28 connected between said second pair of switch electrical connection terminals 39 and said power supply electrical connection terminals 40. Electrical conducting means 21, 22, 27, and 28 are comprised of any material of the class of materials known as electrical conductors, but are preferably electrically conductive wires having an insulating coating.

Flexible strap 5 is comprised of a flexible material that exhibits stretch of less than ten per cent per unit length when placed under a tensile load off up to one hundred pounds. Many such materials are known in the art. A preferred embodiment of flexible strap 5 is that wherein the strap is comprised of nylon webbing material. Said quick release buckle 7 is comprised of a means for tightening the flexible strap by pulling the free end of the strap 19 away from the buckle. Such quick release buckles are known in the art. For instance such buckles are commonly used to tighten and secure strapping material and are often used in applications such as backpacks and tie-down webbing.

Figure 5:
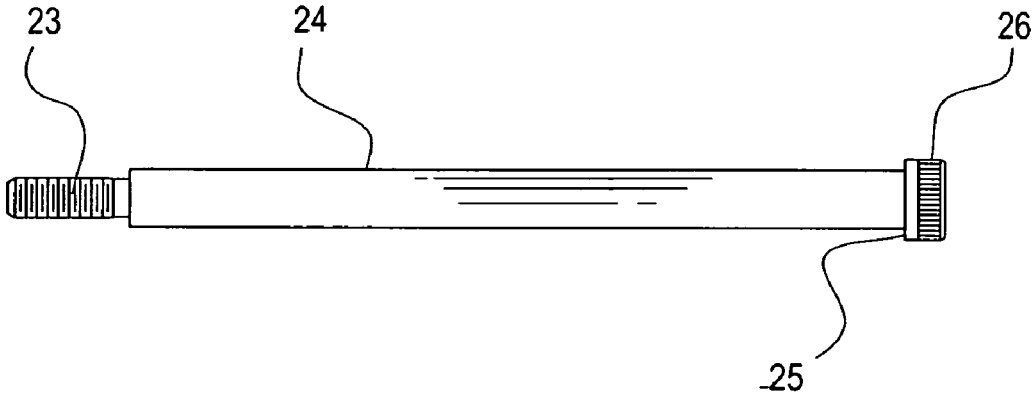
FIG. 5 is a detail view of the shoulder bolt of the invention.

A preferred embodiment of shoulder bolts 9, 10, 34, and 35 is shown in FIG. 5. Referring to FIG. 5, shoulder bolts 9, 10, 34 and 35 are comprised of a male threaded portion 23, a smooth shaft portion 24 which is of any cross section but is preferably circular in cross section, and a head 26 which is constructed to accept a tightening tool selected from the group consisting of screwdrivers, hex keys, box end wrenches, open end socket wrenches, and socket wrenches. Shoulder bolts 9, 10, 34, and 35 are comprised of any material known in the art to be suitable for use in bolts including steel, aluminum, stainless steel, brass, plated brass, nickel plated steel, cadmium plated steel, anodized aluminum, zinc plated steel, oxide-coated steel, or any other material commonly used to fabricate and plate or coat fasteners. The preferred embodiment of the invention as shown in the figures of the drawings comprises four shoulder bolts, but fewer or more shoulder bolts may be used. An alternative embodiment utilizes no shoulder bolts. In this embodiment of the invention, second bracket 4 is kept from turning when the jackscrew turns by a surface of the bracket riding in a sliding fashion on a surface of the boot.

First bracket 3 is securely attached to said electric motor 2 by securing means including chemical bonding, mechanical bonding, or by use of screws, but preferably by a plurality of screws 36 passing through said first bracket 3 into threaded receiving holes in said first surface 41 of said electric motor 2. Jack screw 8 is coupled to said output shaft of electric motor 2, such that said jackscrew 8 turns when electric motor 2 is operated in the FORWARD state or REVERSE state by operation of said switch as described above. Jackscrew 8 is coupled to output shaft of electric motor 2 by any one of a number of means common in the art which include but are not limited to set screws, threading jackscrew 8 onto to output shaft of electric motor 2, a fastener passing through a counterbore in jackscrew 8 and threadingly engaged with electric motor output shaft, or a combination of these means. Other equivalent means exist which are common in the mechanical arts for coupling jackscrew 8 onto output shaft of electric motor 2.

Figure 3:
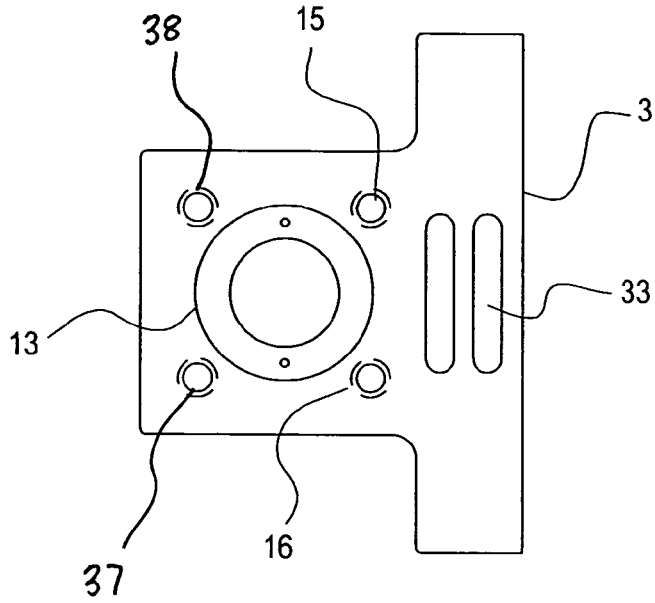
FIG. 3 is a view of the first bracket of the invention.
Figure 4:
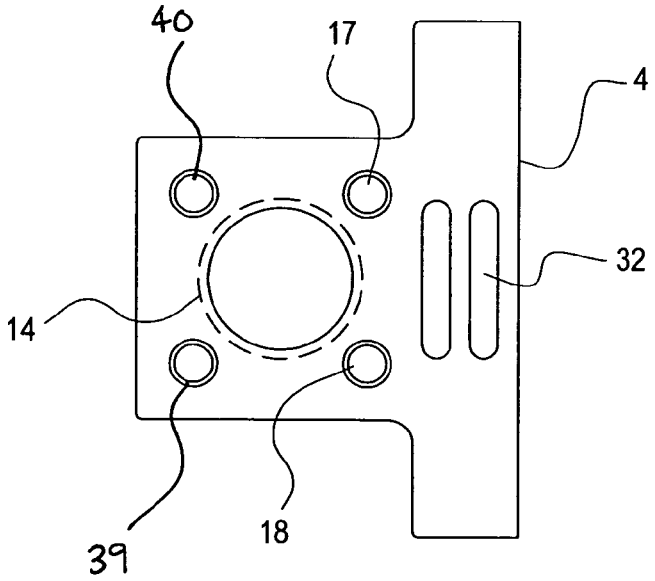
FIG. 4 is a view of the second bracket of the invention.

First bracket 3 and second bracket 4 are fabricated from any material suitable for light structural loads including but not limited to aluminum, steel, brass, plated steel, plated brass, reinforced plastic, or carbon composite materials. Referring to FIG. 3, first bracket 3 further comprises a clearance hole 13 of sufficient diameter to allow jackscrew 8 to pass through said clearance hole without touching any portion of said first bracket 3, a plurality of female threaded holes 15, 16, 37, and 38 which are threadingly engaged to male threaded portion 23 of shoulder bolts 10, 9, 35, and 34 respectively, and a pair of openings 33 through which flexible strap 5 passes and is secured back upon itself by stitching in the manner shown in FIG. 8. Referring to FIG. 4, said second bracket 4 comprises a female threaded hole 14 threadingly engaged with jackscrew 8 such that second bracket 4 rides along jackscrew 8 and shoulder bolts 9, 10, 34, and 35 when electric motor 2 is operated in the FORWARD or REVERSE state. Second bracket 4 further comprises clearance holes 17, 18, 39, and 40 which are slidingly engaged with smooth portion 24 of shoulder bolts 10, 9, 35, and 34 respectively. Said second bracket 4 further comprises a pair of openings 32 through which flexible strap 5 passes and is secured back upon itself by stitching in the manner shown in FIG. 7.

The first alternate embodiment of the invention, described above, does not depend upon the use of shoulder bolts. In said first alternate embodiment of the invention, said first bracket 3 and said second bracket 4 are not engaged with any shoulder bolt, and said bracket 4 simply rides upon jackscrew 8, and is kept from turning by action of the bracket sliding along a surface of the boot. Furthermore, in said first alternate embodiment of the invention, threaded holes 15, 16, 37, and 38 in said first bracket 3 are not required, and clearance holes 17, 18, 39, and 40 in said second bracket 4 are not required.

Figure 7:
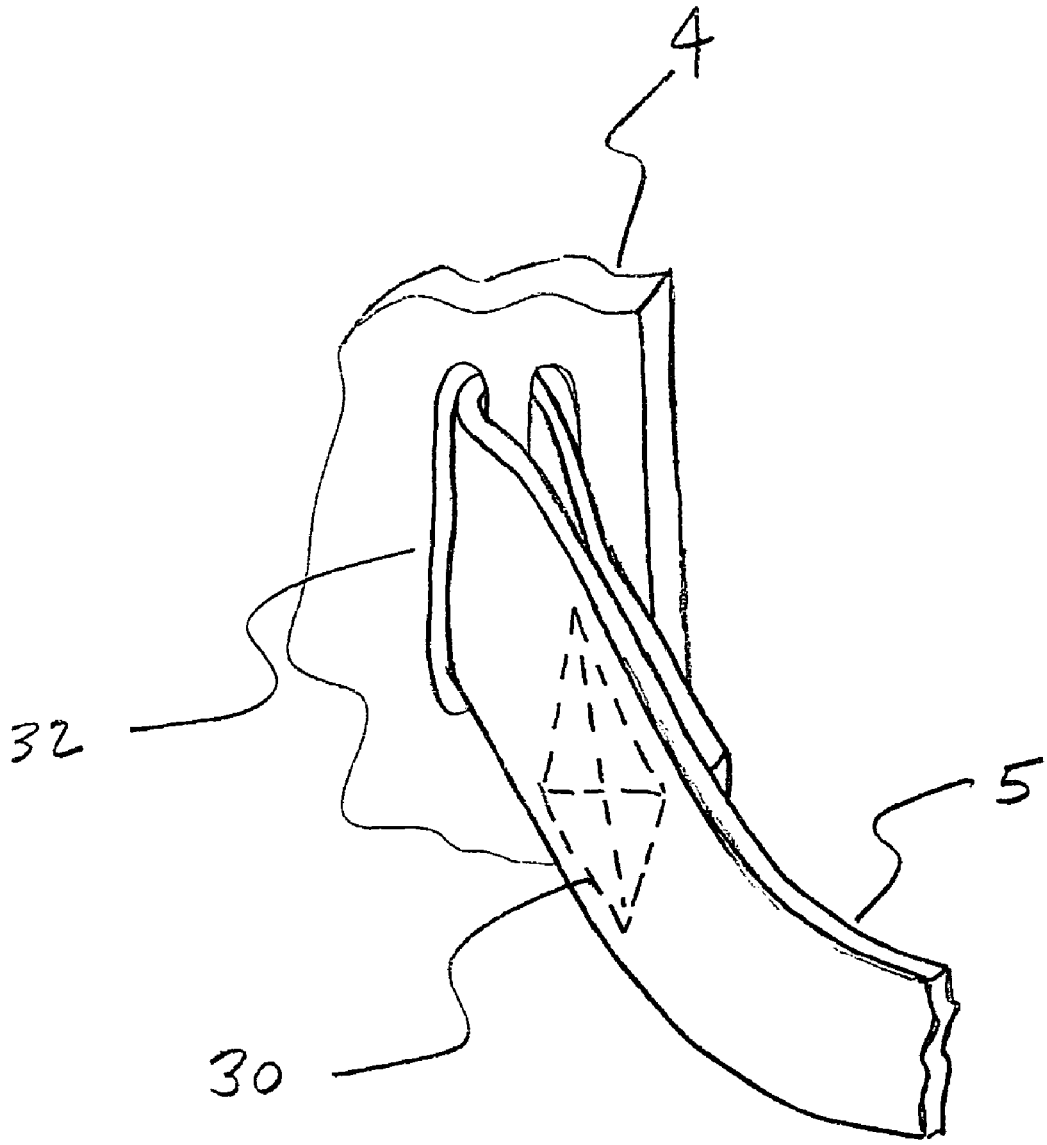
FIG. 7 is a perspective view of the second bracket, showing the attachment of the flexible strap to the bracket.

Referring to FIG. 7, said first end of flexible strap 5 is secured to bracket 4 in the manner shown. Said first end of strap 5 passes through the pair of openings in bracket 4, and is attached to strap 5 preferably by stitching means, said stitching means being of any pattern including the pattern shown in FIG. 7. The pattern shown in FIG. 5 is intended only to show a representative pattern. Alternative attaching means such as rivets and other fasteners are well known in the art and may be used instead of stitching.

Figure 8:
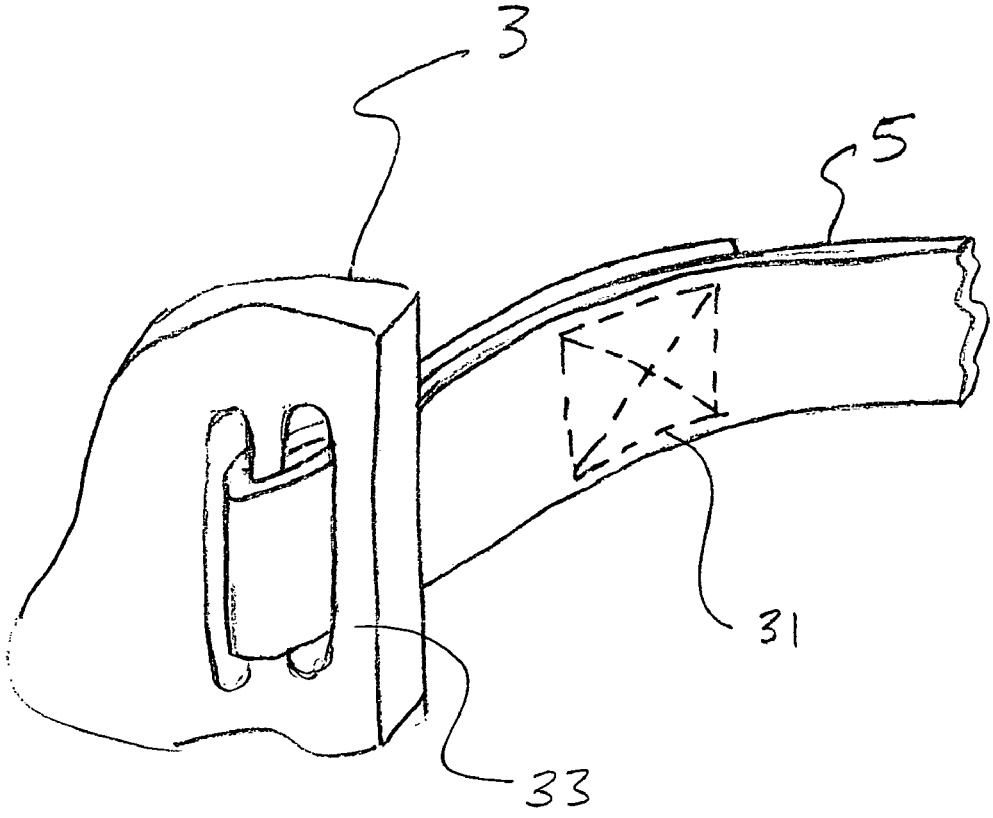
FIG. 8 is a perspective view of the first bracket, showing the attachment of the flexible strap to the bracket.

Referring to FIG. 8, said second end of flexible strap 5 is secured to bracket 3 in the manner shown. Said first end of strap 5 passes through the pair of openings in bracket 3, and is attached to strap 5 by stitching means, said stitching means being of any pattern including the pattern shown in FIG. 8. The pattern shown in FIG. 8 is intended only to show a representative pattern. Alternative attaching means such as rivets and other fasteners are well known in the art and may be used instead of stitching.

A second alternative embodiment of the invention further comprises an internal system of gears to reduce the speed of rotation of the jackscrew, said gears coupled between output shaft of said electric motor 2 and jackscrew 8. Yet another embodiment of the invention is that in which said system of internal gears is coupled to a clutch which operates to de-couple said system of gears from said jackscrew once a given resistance to rotation is achieved. Yet another embodiment of the invention is that in which the pressure at which the clutch de-couples the system of gears from said jackscrew is user-selectable among a plurality of discrete settings, which allows the user to determine the resistance to turning at which the clutch disengages said system of gears from said jackscrew. Said system of gears and clutch, including the user-selectable clutch, is old in the art and is commonly used, for instance, in cordless drills which are readily available at hardware stores.

Figure 9:
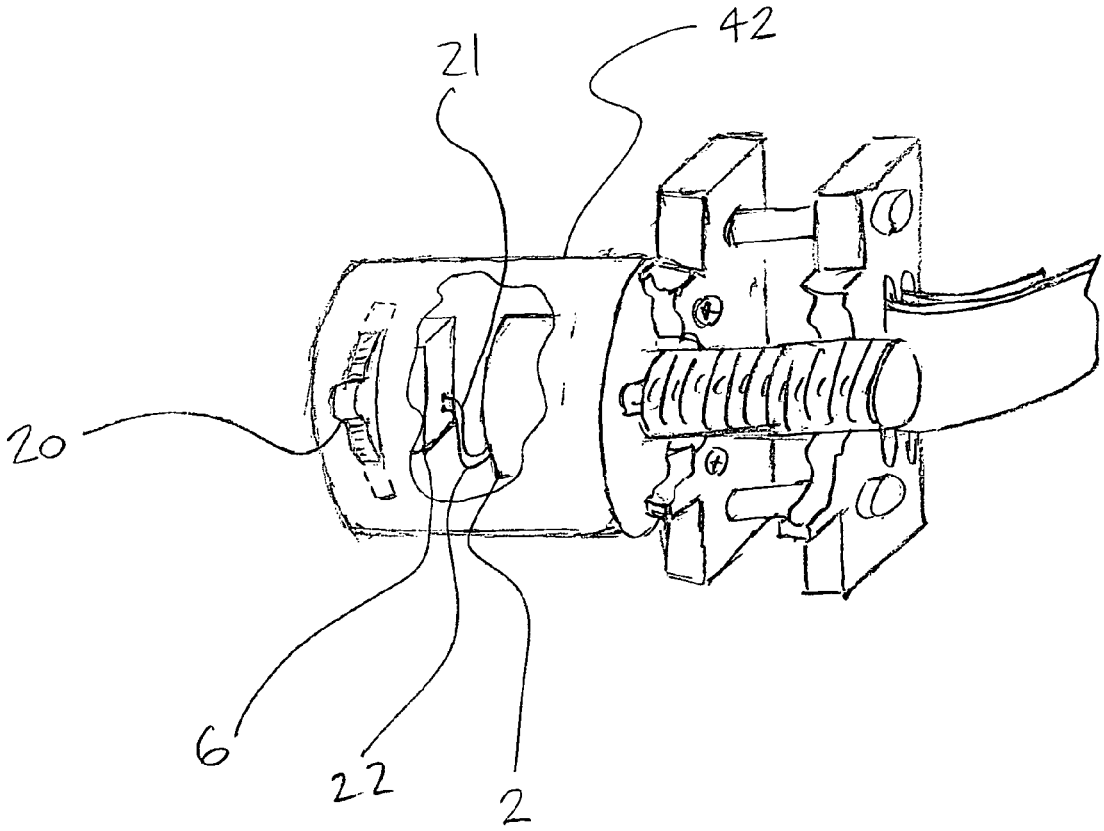
FIG. 9 is a perspective view of an alternate embodiment of the invention.
Figure 10:
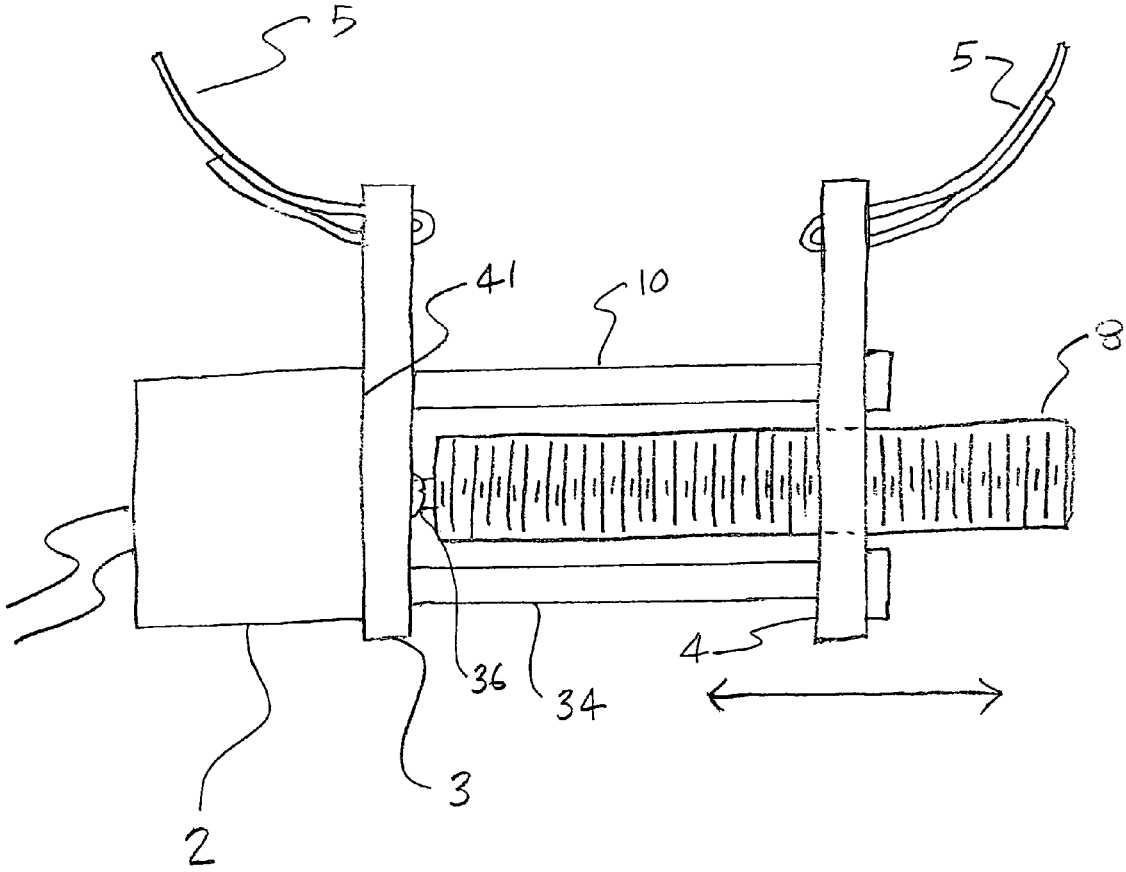
FIG. 10 is a partial top view of the invention.

Referring to FIG. 9, a second alternative embodiment of the invention is one wherein said switch 20, said power supply 6, and said electric motor 2 are housed within a single enclosure 34. Power supply 6 and electric motor 2 are secured within housing 42 by chemical bonding means or mechanical securing means which are well known in the art and may include the use of screws, snap-in molded retainers, or other well known mechanical means. This embodiment provides a compact arrangement of the invention that is highly portable, small, and easy to store when not in use.

The preferred embodiments and alternative embodiments described herein may be used in any combination.

The wearer uses the invention by placing his foot into the boot 1. Next, the wearer places flexible strap 5 around the boot and engages the quick release buckle together as shown in FIG. 1. The wearer pulls on the free end of the flexible strap 19 to create a snug fit of the flexible strap around the boot. If desired, the wearer selects a resistance at which the clutch disengages the drive to the jackscrew. The wearer now operates said switch into the FORWARD position, causing the flexible strap 5 to tighten around boot 1, and causing boot 1 to snug around the wearer's calf to produce a desired fit. When the desired snug fit is achieved, the wearer operates said switch to the OFF position, causing said electric motor output shaft to cease turning. The wearer then locks the parts of the boot in place utilizing the latches provided on the boot. The wearer then unbuckles quick release buckle 7 and removes the invention from around the boot. The invention may then be stored for further use. The user may next manipulate switch 6 to the REVERSE position, causing electric motor 2 to operate in the REVERSE state to cause first bracket 3 and second bracket 4 to separate, such that the apparatus is ready for use once again.

The invention is also directed to a method for tightening a boot, especially a snow ski boot, around the ankle and calf of the wearer comprising the steps of providing a boot having locking latches to lock the boot onto the calf of the wearer and further comprising the boot parts to be brought together onto the calf of the wearer at a desired pressure, inserting a foot of the wearer into said boot, placing said flexible strap around said boot, securing said flexible strap in place around said boot by buckling said quick release buckle, pulling said flexible strap around the boot by pulling on excess strap 19 to shorten the amount of flexible strap surrounding said boot and thereby snugging the boot parts against the calf of the wearer in a firm manner, operating an electric motor to cause said jackscrew to bring said first bracket and said second bracket together in proximity resulting in the tightening of said flexible strap around said boot, operating said electric motor to said OFF state after the desired pressure on said wearer's leg is reached, operating said latches on said boot to lock said parts of the boot in place at the desired pressure, and releasing said quick release buckle on said flexible strap to remove said boot tightening apparatus from the boot.

While particular embodiments of the invention have been described, it is obvious that numerous other embodiments of the invention may be realized by one skilled in the mechanical arts, without departure from the spirit and gist of the invention.

We claim:

1. A boot tightening apparatus comprising:

a reversible electric motor having an output shaft, a first surface, and a pair of electrical connection terminals, said electric motor capable of operating in a FORWARD state, a REVERSE state, and an OFF state, a power supply comprising a voltage source and a pair of electrical connection terminals, a switch having a FORWARD position, a REVERSE position, and an OFF position, and having a first pair of electrical connection terminals and a second pair of electrical connection terminals, wherein said first pair of electrical connection terminals are electrically connected to said electric motor pair of electrical terminals by electrical connection means, and wherein said second pair of electrical connection terminals are electrically connected to said power supply electrical connection terminals by electrical connection means, a jackscrew comprising a threaded rod coupled to said output shaft of said electric motor, a plurality of shoulder bolts each comprising a head, a smooth shaft, and a male threaded portion, a first bracket having a clearance opening sufficient in diameter to allow said jackscrew to pass through said clearance hole without touching any surface of said first bracket and having a plurality of threaded openings threadingly engaged with said male threaded portion of said plurality of shoulder bolts, and said first bracket secured to said first surface of said electric motor by mechanical bonding means, a second bracket having a threaded hole threadingly engaged with said jackscrew and further having a plurality of clearance holes slidingly engaged to said smooth shaft portion of said plurality of shoulder bolts, and a flexible strap having a first end and a second end further comprising a quick-release buckle, said first end of said flexible strap secured to said first bracket passing through said strap opening in said first bracket and attached to said strap material by attaching means, and said second end of said flexible strap secured to said second bracket by passing through said strap opening of said second bracket and attached to said strap material by attaching means.

2. The boot tightening apparatus of claim 1, wherein said electric motor is a direct current motor and wherein said power supply is a battery.

3. The boot tightening apparatus of claim 2, wherein said electric motor is a variable speed direct current motor, and wherein said switch is a momentary switch.

4. A boot tightening apparatus comprising:

a reversible electric motor having an output shaft, a first surface, and a pair of electrical connection terminals, said electric motor capable of operating in a FORWARD state, a REVERSE state, and an OFF state, a power supply comprising a voltage source and a pair of electrical connection terminals, a switch having a FORWARD position, a REVERSE position, and an OFF position, and having a first pair of electrical connection terminals and a second pair of electrical connection terminals, wherein said first pair of electrical connection terminals are electrically connected to said electric motor pair of electrical terminals by electrical connection means, and wherein said second pair of electrical connection terminals are electrically connected to said power supply electrical connection terminals by electrical connection means, a jackscrew comprising a threaded rod coupled to said output shaft of said electric motor, a first bracket having a clearance opening sufficient in diameter to allow said jackscrew to pass through said clearance hole without touching any surface of said first bracket, said first bracket secured to said first surface of said electric motor by mechanical bonding means, a second bracket having a threaded hole threadingly engaged with said jackscrew, and a flexible strap having a first end and a second end further comprising a quick-release buckle, said first end of said flexible strap secured to said first bracket passing through said strap opening in said first bracket and attached to said strap material by attaching means, and said second end of said flexible strap secured to said second bracket by passing through said strap opening of said second bracket and attached to said strap material by attaching means.

5. The boot tightening apparatus of claim 4, wherein said electric motor is a direct current motor and wherein said power supply is a battery.

6. The boot tightening apparatus of claim 5, wherein said electric motor is a variable speed direct current motor, and wherein said switch is a momentary switch.

7. The boot tightening apparatus of claim 1, 2, 3, 4, 5,or 6 further comprising a gearbox and clutch coupled between the output shaft of said electric motor and said jackscrew.

8. The boot tightening apparatus of claim 7, wherein said clutch further comprises a user-selectable resistance setting.

9. The boot tightening apparatus of claim 1, 2, 3, 4, 5, or 6 wherein said power supply, electric motor, and switch are housed within a single housing.

10. A method for tightening boots onto the leg of a wearer, comprising the steps of:

providing a boot having locking latches to lock the boot onto a calf of the wearer and further comprising parts to be brought together onto the calf of the wearer at a desired pressure;

inserting a foot of the wearer into said boot;

closing said boot parts around the calf of the user;

placing a flexible strap around said parts of said boot;

snugging said boot against said calf of the wearer by operating an electric motor to tighten said strap around said boot parts;

operating said latches on said boot to lock parts of the boot in place, and removing said flexible strap and electric motor from said boot.

11. The method of claim 10 wherein said boot is a snow ski boot.

12. A method for tightening boots onto the leg of a wearer as in claim 10 wherein the step of snugging said boot against said calf of the wearer by operating an electric motor further includes the step of turning a jackscrew by operation the electric motor, said jackscrew operating to bring a first bracket and second bracket together to reduce the circumference of a flexible strap having a first end connected to said first bracket and a second end connected to said second bracket, said flexible strap placed around the circumference of the boot.

13. The method of claim 12, wherein said boot is a snow ski boot.

* * * * *